United States Patent [19]

Tanaka et al.

[11] 3,936,910

[45] Feb. 10, 1976

[54] CARDING METHOD AND MACHINE

[75] Inventors: Toyozo Tanaka; Shigeyoshi Kubota; Masao Kunieda, all of Yamatotakada, Japan

[73] Assignee: Unitika Limited, Osaka, Japan

[22] Filed: Apr. 29, 1974

[21] Appl. No.: 464,958

[30] Foreign Application Priority Data

Apr. 28, 1973 Japan ..... 48-194

[52] U.S. Cl. ..... 19/102; 19/111

[51] Int. Cl.[2] ..... D01G 15/08

[58] Field of Search ..... 19/102, 111, 108, 110, 19/103

[56] References Cited

UNITED STATES PATENTS

| | | | |
|---|---|---|---|
| 857,713 | 6/1907 | Batten et al. | 19/102 |
| 878,884 | 2/1908 | Kip et al. | 19/102 |

*Primary Examiner*—Dorsey Newton

*Attorney, Agent, or Firm*—Farley, Forster and Farley

[57] ABSTRACT

A carding method in which the rotary flats of a carding machine are driven intermittently so that each time the flats are driven only a portion (1/6 to 1/4) of the flats opposed to the cylinder of the machine are replaced by fresh flats, thereby decreasing the amount of good fibers in the waste, particularly when carding synthetic fibers.

The carding machine is provided with a solenoid clutch in the drive mechanism for the rotary flats and the flat cleaning means, and with a timer for controlling the clutch so that the flats can be intermittently driven at desired drive and stop intervals. For carding polyester fiber, the drive interval may be enough to replace one-fifth of the flats opposed to the cylinder of the machine with fresh flats, and the stop interval may be as much as sixty minutes.

12 Claims, 4 Drawing Figures

CARDING METHOD AND MACHINE

The present invention relates to a carding method using a carding machine with rotary flats, and to a carding machine for practicing this method.

Generally, the purpose of using the carding machine is to apply to a lap the carding action of stretching fibers which are hardly stretched up to the lap forming process, or fibers which are shrunken as a result of curling or bending; and also the action of removing various extraneous substances and neps, or fibers which are short to the point of being unsuitable for spinning, and glued fibers and other impurities; and, to provide a sliver consisting of a bunch of completely separated, stretched long fibers.

Thus, the needle density and the length of that portion of the loop of rotary flats which is opposed to the cylinder in the carding machine used for the general cotton carding process are determined so as to be suitable for cotton carding and the intended carding is achieved by driving the cylinder and flats at predetermined speeds. When the carding of synthetic short fibers such as polyester fibers is performed on such a cotton carding machine, it has been found that the card waste, or so-called strips from the flats contain a much larger amount of sufficiently suitable good fibers than in the case of the carding of cotton. In this connection, it is noted that usually a lap of synthetic fibers contains none of the extraneous substances such as cotton seed shell debris and dirt found in cotton laps and a very little amount of impurities such as neps and fibers too short for spinning. When such synthetic fiber lap is fed to the conventional carding machine, therefore, it is expected that only the movement of the fibers over a relatively short region of the entire path length along which the flats are opposed to the cylinder is enough for the fibers to finish undergoing both the carding action and the impurity removing action to the extent necessary and sufficient for achieving the intended object. Further, since the amount of various impurities arrested by the needles on the flats is very small, it follows that the synthetic fibers which have finished moving over said short region from the entrance are subjected to the carding action of the flat needles still having the sufficient fiber arresting function over the entire remaining region, during which, as it is surmised, good fibers subjected to centrifugal action float up and are arrested by the flat needles.

The presence of a large amount of good fibers in the card waste as described above results in the decrease of yield and hence in the increase of production cost. A principal object of the present invention is to enable the increase of yield and the production of a sliver of good quality suitable for spinning yarn even in the case of carding synthetic fibers on a carding machine.

Thus, the present method is characterized in that in a carding machine using rotary flats, the flats are intermittently driven on repetitive drive and stop intervals with the unit feed length on each drive interval being less than the length of that portion of the loop of flats which is opposed to the cylinder.

According to this method, the flats are intermittently driven with consideration given to the length of the stop interval so that the rotation of the flats is stopped until cleaned flats, introduced into the region corresponding in length to said unit feed length from the entrance to the carding work path between the cylinder and the flats, substantially lose the function of arresting impurities and the like, or they become unable to arrest any more impurities and the like due to the previously arrested impurities and the like. As a result, there is no longer substantially any danger of good fibers being arrested by the flat needles present in the long carding work path extending from the terminal end of said region to the exit. If, therefore, the carding of synthetic fibers, which are supposed to provide a sliver of good quality even if subjected to carding and impurity removing actions only in said region in the vicinity of the entrance, is performed by the present method described above, then, despite the use of a cotton carding machine, the chance of good fibers being arrested is limited to the time when they are moving in the small region in the vicinity of the entrance, with the result that the rate at which good fibers are arrested and removed is greatly decreased as a whole with the consequent increase of yield, and yet a sliver of good quality suitable for spinning yarns can be obtained.

The present method is not limited to the carding of synthetic fibers, and in some cases it may be utilized for the carding of cotton fibers. For example, in the case of carding a lap which has been sufficiently cleaned in the preceding scutching process or of producing a sliver for which some decrease in quality is tolerated from the standpoint of use, the present method may be utilized by taking into consideration the unit feed length and the length of stop time for the flats.

The unit feed length and the length of stop time for the flats in the present method is empirically determined so as to achieve maximum yield without lowering the quality of sliver below the required level.

According to a preferred embodiment of the present invention, the present method is practices by interposing a clutch in a rotation transmitting system extending from the cylinder to the flats and automatically engaging and disengaging said clutch by means of a timer.

Other features and merits of the present invention will be readily understood from the following description of a preferred embodiment of the invention with reference to the accompanying drawings, in which.

Figure 1:
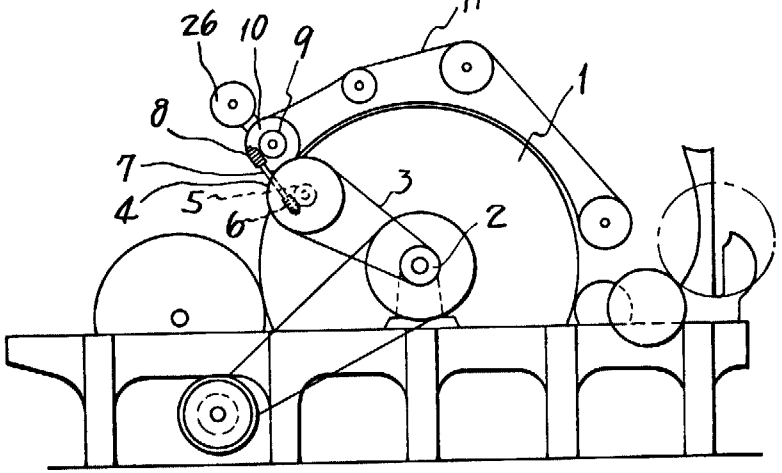
FIG. 1 is a schematic side view of a carding machine using rotary flats.
Figure 2:
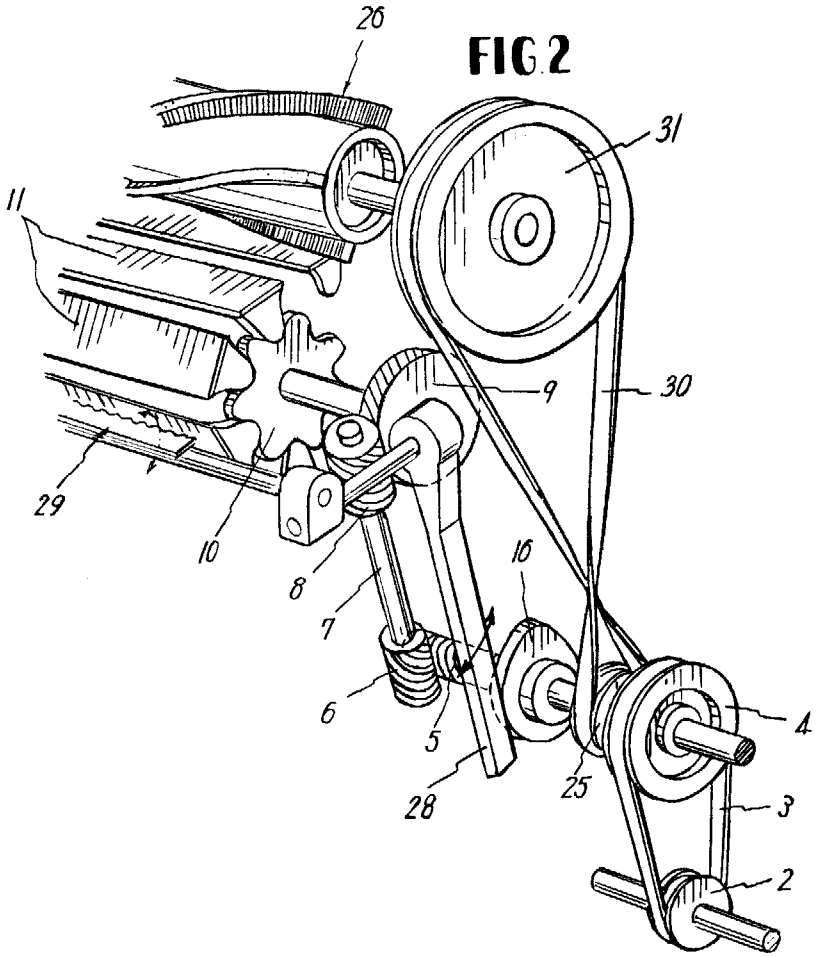
FIG. 2 is an enlarged perspective view of a flat driving device.

In FIGS. 1 and 2, a transmission pulley 2, which rotates together with a cylinder 1 driven by a motor, drives an intermediate driven pulley 4 through a belt 3. A worm gear 5 coaxial with the driven pulley 4 transmits the rotation of the driven pulley 4 to a notch block 10 through a mating worm wheel 6, an intermediate shaft 7, a worm gear 8 and a mating worm wheel 9. The rotation of the notch block 10 results in driving flats 11 installed over the cylinder 1 at a constant speed ratio to the cylinder 1.

Figure 3:
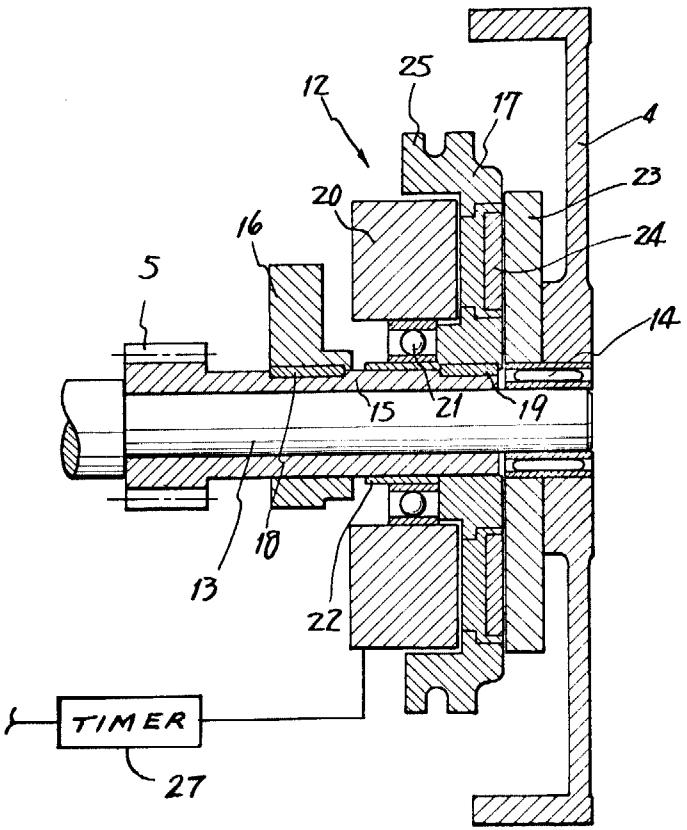
FIG. 3 is a longitudinal section showing an example of an intermittent drive.

FIG. 3 shows a preferred embodiment of the present invention wherein a solenoid clutch 12 is interposed between the driven pulley 4 and the worm gear 5 in order to intermittently drive the flats. A support shaft 13 projecting from a fixed frame supports the worm gear 5 of the long boss type for rotation thereon. It also supports the driven pulley 4 for rotation thereon with a needle bearing 14 therebetween. An eccentric cam 16 acts on a lever 28 to operate a stripping comb 29 for removing strips from the flats, and the driven disc 17 of the solenoid clutch 12 are fixedly mounted on the boss 15 of the worm gear 5 by keys 18 and 19, respectively. The stationary part (including the coil) 20 of the solenoid clutch 12 is supported on the boss 22 of the driven disc 17 with a ball bearing 21 therebetween. The friction surface of the driven disc 17 is opposed to an armature 23 fixed to the driven pulley 4 and has a lining 24 fixed thereto. A grooved pulley 25 integral with the driven pulley 17 serves as a transmission pulley for driving, through a belt 30 and pulley 31, a circular brush 26 which forms a flat cleaning means. A timer 27 in a circuit to the solenoid coil 20 permits the clutch to be energized and deenergized at desired intervals.

The driven pulley 4 is being rotated all the time when the cylinder 1 is being driven, but since the armature 23 and the lining 24 are separated from each other when the solenoid clutch 12 is not energized, the rotation of the driven pulley 4 is not then transmitted to the worm gear 5. Therefore, the flats 11 perform carding in their stopped state. Under these conditions a certain period passes and immediately before the cleaned needles on the flats included in the unit length previously inserted to the position opposed to the cylinder by the previous rotation of the flats lose the function of arresting impurities and the like, the solenoid clutch 12 is energized. (The time at which it is energized is present by the timer 27). As a result, the armature 23 and the lining 24 are attracted to each other to become a unitary body, so that the rotation of the driven pulley 4 is transmitted to the long boss worm gear 5 through the armature 23, lining 24 and driven disc 17, thereby driving the flats 11, the brush 26 and the stripping comb 29 through the transmission system shown in FIG. 2. As a result, cleaned fresh flats 11 are inserted to the position opposed to the cylinder and perform the intended carding operation accordingly. The used flats occupying the path extending from said newly inserted flats to the end on the doffer side have arrested impurities to the extent that they have already lost the function of arresting impurities and the like. Therefore, as previously described, there is almost no danger of such used flats arresting good fibers from the lap fibers moving in opposition to the used flats.

The unit feed length for cleaned flats depends on the duration of energization of the solenoid clutch 12 and the rotative speed of the flats, but the duration of energization of the solenoid clutch 12 is preset by the timer so that the unit feed length is a fraction of the length of the flat path opposed to the cylinder.

The following table shows the results of a test in which the present method was applied to an existing carding machine to card a synthetic fiber of 100 percent polyester ($1.3^d \times 38^{mm}$).

| Flat drive system | Measurement time | Strips from flats | Strips from flats calculated on a 120-min. conversion basis | Flat continuous operation-strips from flats ratio |
|---|---|---|---|---|
| continuous operation | 120 min. | 150.0 g | 150.0 g | 100% |
| 5-min. drive+5-min. stop | 120 | 92.5 | 92.5 | 61.7 |
| 5-min. drive+10-min. stop | 120 | 56.5 | 56.5 | 37.7 |
| 5-min. drive +15-min. stop | 120 | 36.0 | 36.0 | 24.0 |
| 5-min. drive+30-min. stop | 140 | 29.5 | 25.3 | 16.9 |
| 5-min. drive+60-min. stop | 130 | 15.3 | 14.1 | 9.4 |

*Conditions of carding:
cylinder, 280R/M; doffer, 18.5R/M; flat speed, 54 mm/min; grains, 310gr/6yd; kind of material to be carded, polyester ($1.3^d \times 38^{mm}$)100%

In addition, the conditions for carding were: rotative speed of cylinder, 280 r.p.m.; rotative speed of doffer, 18.5 r.p.m.; flat speed, 54/mm/min; length of flat portion opposed to cylinder, 1400 mm; resulting sliver, 310gr/6yd.

Figure 4:
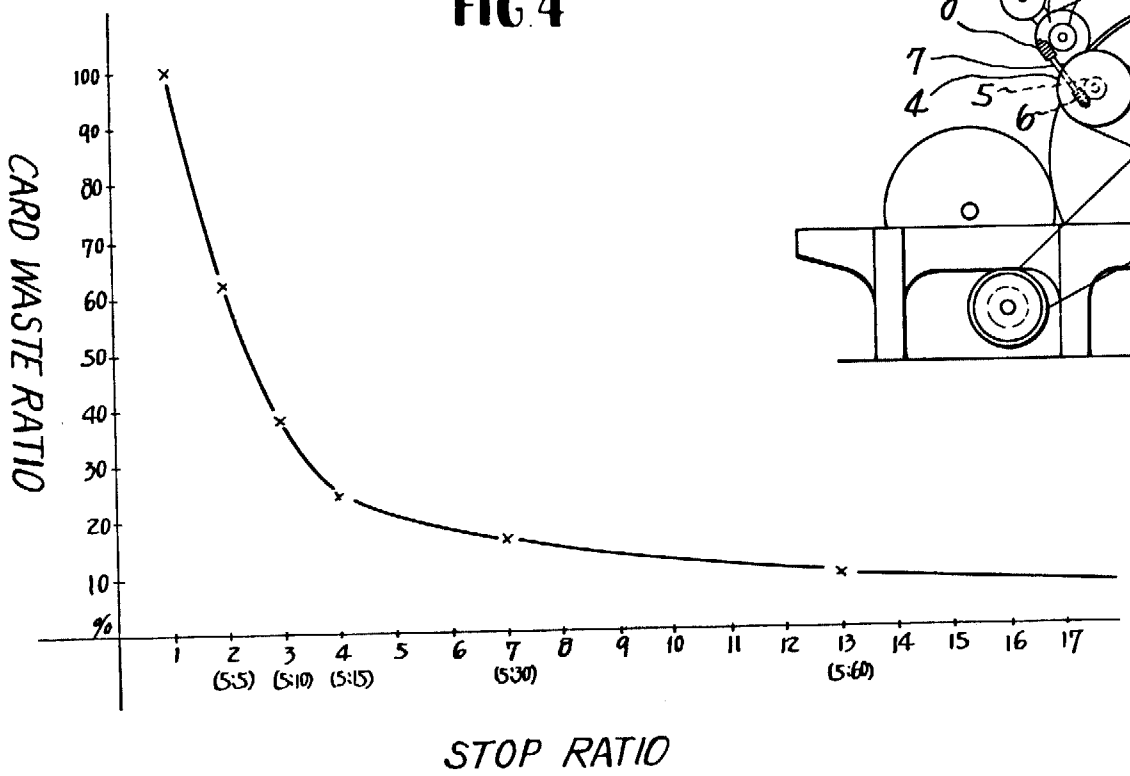
FIG. 4 is a graph showing the relation between stop ratio and card waste ratio.

FIG. 4 shows the above test results in the form of a card waste change curve. In this graph, stop ratio $$= \frac{\text{flat drive time + flat stop time}}{\text{flat drive time}} \times 100$$

is plotted on the horizontal axis and card waste ratio $$= \frac{\text{amount of card waste for (flat drive time + flat stop time)}}{\text{amount of card waste for continuous flat operation time}} \times 100$$ is plotted on the vertical axis.

$\times$ 100 is plotted on the vertical axis.

As is apparent from the above table and FIG. 4, the longer the stop time, the less the amount of strips from the flats and hence the amount of good fibers in the strips decreases and yield increases. Moreover, the operation with 5 minute drive and 60 minute stop intervals showed no abnormality in the quality of the resulting sliver. On each such drive interval, a unit feed length of 270 mm of clean flats was introduced into the portion of the loop of flats opposed to the cylinder, or approximately one-fifth the length of such portion. Considering the physical differences in carding machines known to us, the preferred unit feed length on each drive interval may vary between one-sixth and one-fourth the length of the flat portion opposed to the cylinder. FIG. 4 shows that when the stop interval is less than 10 minutes, the card waste ratio increases greatly

We claim:

1. A carding method using a carding machine having a cylinder and a loop of rotary flats, a portion of which loop is opposed to the cylinder, comprising intermittently driving the flats with repetitive drive and stop intervals, and feeding a unit length of flats on each drive interval less than the length of said portion of the loop of flats.

2. A carding method as set forth in claim 1, characterized in that said unit length of flats fed on each drive interval is a fraction of the length of said portion of the loop of flats which is opposed to the cylinder.

3. A carding method as set forth in claim 1, characterized in that said stop interval is greater than said drive interval.

4. A carding method as set forth in claim 1, characterized in that said stop is not less than said drive interval.

5. A carding method as set forth in claim 1, characterized in that the unit length of flats fed on each drive interval is on the order of (one-sixth to one-fourth) the length of said loop portion, and that each stop interval is not less than 10 minutes.

6. A carding method as set forth in claim 1, characterized in that the unit length of flats fed on each drive interval is on the order of one-sixth to one-fourth the length of said loop portion, and that each stop interval is about 60 minutes.

7. In a carding machine having a cylinder, a loop of rotary flats, and means for transmitting power to the flats, the improvement wherein said power transmitting means includes a clutch, and means for engaging and disengaging said clutch for timed intervals thereby intermittently driving the flats.

8. A carding machine according to claim 7 wherein said clutch includes a solenoid, and said means for engaging and disengaging said clutch comprises a timer for controlling the energizing and deenergizing of said solenoid.

9. A carding machine according to claim 7 wherein said power transmitting means includes a shaft, a worm gear mounted on said shaft and having a long boss coaxial therewith, a driving pulley rotatable on said shaft, and said clutch is arranged to couple said driving pulley and the long boss of said worm gear.

10. A carding machine according to claim 7 further including a stripping comb for stripping said flats and means driven through said clutch for intermittently operating said stripping comb.

11. A carding machine according to claim 7 further including flat cleaning means, and driving means for said flat cleaning means, said driving means being intermittently operable by said clutch.

12. A carding machine according to claim 9 further including a stripping comb and means for cleaning said flats, and individual driving means carried by the long boss of said worm gear for separately operating each said stripping comb and said flat cleaning means.

* * * * *

UNITED STATES PATENT AND TRADEMARK OFFICE

CERTIFICATE OF CORRECTION

PATENT NO. : 3,936,910

DATED : February 10, 1976

INVENTOR(S) : Toyozo Tanaka, Shigeyoshi Kubota, Masao Kunieda

It is certified that error appears in the above-identified patent and that said Letters Patent are hereby corrected as shown below:

Column 2, line 35, "practices" should read --practiced--;

Column 3, line 47, "present" should read --preset--;

Column 4, line 39, delete "x 100 is plotted on the vertical axis."

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*